United States Patent [19]

Doi et al.

[11] B 3,997,262

[45] Dec. 14, 1976

[54] ELECTROPHOTOGRAPHIC COPYING APPARATUS

[75] Inventors: Yasuhiko Doi, Toyokawa; Shunji Yamamoto, Shinshiro; Osamu Okada, Toyokawa; Takashi Hikosaka; Masamichi Hayashi, both of Aichi, all of Japan

[73] Assignee: Minolta Camera Kabushiki Kaisha, Osaka, Japan

[22] Filed: Aug. 23, 1974

[21] Appl. No.: 500,171

[44] Published under the second Trial Voluntary Protest Program on March 30, 1976 as document No. B 500,171.

[30] Foreign Application Priority Data

Sept. 7, 1973 Japan ..... 48-101372

[52] U.S. Cl. ..... 355/11; 355/8; 355/3 R; 96/1 R; 219/216

[51] Int. Cl.[2] ..... G03G 15/18; G03G 15/00

[58] Field of Search ..... 355/11, 8, 3 FU, 3 TE, 355/3 DR, 3 SH, 3 R; 96/1 IT, 1; 219/216

[56] References Cited

UNITED STATES PATENTS

| | | | |
|---|---|---|---|
| 3,015,304 | 1/1962 | Carlson et al. | 355/11 X |
| 3,240,596 | 3/1966 | Medley et al. | 96/1 TE |
| 3,630,608 | 12/1971 | Sage | 355/8 |
| 3,705,768 | 12/1972 | Moraw et al. | 355/11 X |

*Primary Examiner*—Robert P. Greiner
*Attorney, Agent, or Firm*—Wenderoth, Lind & Ponack

[57] ABSTRACT

A transfer type electrophotographic copying apparatus with a reciprocating platform to place an original to be copied thereon, which comprises a rotatable photoreceptor drum of a small diameter, and processing devices of small size disposed around the photoreceptor drum with minimum spaces necessary between the processing devices, so that the size and weight of the copying apparatus can be reduced to a large extent. The housing of the apparatus can be divided into an upper frame and a lower frame with the upper frame pivotally connected to the lower frame for easy access to the internal mechanisms in maintenance and replacing of the parts.

5 Claims, 18 Drawing Figures

(a)

(b)

(c)

ELECTROPHOTOGRAPHIC COPYING APPARATUS

The present invention relates to a copying apparatus and, more particularly to a transfer type electrophotographic copying apparatus with a movable platform to place an original to be copied thereon.

Conventionally, in the copying apparatus of the above described type, a copying system known as the Carlson system, in which an electrostatic latent image formed on an electrophotosensitive photoreceptor in the configuraiton of a drum or an endless belt is subsequently visualized by applying thereto a developing material in the form of powder or liquid for the transfer of the visualized image onto a copy paper sheet, or another system whereon the latent image formed on the photoreceptor is directly transferred onto a copy paper sheet without visualization, with the latent image transferred onto the copy paper sheet subsequently developed for obtaining the copy of the original, is usually employed.

In the copying apparatus of the above described type, however, despite the long felt needs for compact size and simple handling, there has been none which completely satisifies such needs.

In other words, in the conventional visualized image transfer type copying apparatus as described above, it is necessary to dispose various processing devices, such as a corona charger, an exposure device, a developing device, a transfer device, a copy paper sheet separating device, charge erasing devices and a cleaning device etc., around the photoreceptor, which arrangement inevitably results in a large size of the photoreceptor itself and complicated construction of the copying apparatus as a whole with consequent troublesome maintenance, while in the latter type which develops the latent image transferred on the copy paper sheet, no copying apparatus sufficiently fit for practical use has been developed as yet, though this latter type of copying apparatus can eliminate the disadvantages inherent in the former type since the developing device need not be located around the photoreceptor.

Accordingly, an essential object of the present invention is to provide an electrophotographic copying apparatus which is compact in size and light in weight with substatial elimination of the disadvantages inherent in the conventional copying apparatus.

Another important object of the present invention is to provide an electrophotographic copying apparatus of the above described type which is comparatively simple in construction and easy to maintain.

A further object of the present invention is to provide an electrophotographic copying apparatus of the above described type which is easy to operate and accurate in functioning for providing clear and definite copies of the original.

According to the copying apparatus of the present invention, various devices, such as devices for corona charging, exposure, transfer, and charge erasing etc., are made compact in size, each of which devices is efficiently disposed around the photoreceptor drum with minimum spaces necessary therebetween, thus making it possible to adopt the photoreceptor drum of a small diameter. At least part of the surface of the photoreceptor drum is adapted to form the latent image more than one time during one copying operation, and a slit exposure type optical system with a movable platform for placing an original thereon, in which the light path from the original to be copied to the photoreceptor surface on the drum is arranged to cross one time at a predetermined position, is employed for use with the small sized photoreceptor drum so that the distance between the platform and the photoreceptor drum is minimized and consequently the size of the copying apparatus can be reduced to a size approximately equal to a small type of a so called Electrofax type copying apparatus.

Furthermore, the housing of the apparatus of the invention is adapted to be divided into two portions, i.e., an upper frame including the latent image forming means, and a lower frame including devices for copy paper feeding, transfer, developing and fixing etc., with the upper frame pivotally connected to the lower frame for raising the former about the pivotal connection, by which arrangement inside mechanisms of the copying apparatus are easily accessible, thus replacing and maintenance of the photoreceptor drum or other machine parts being effected very efficiently.

These and other objects and features of the present invention will become apparent from the following description taken in conjunction with the preferred embodiment thereof with reference to the accompanying drawings, in which;

FIG. 6(*b*) is a schematic diagram particularly showing a driving system of the developing device in FIG. 6(*a*);

FIG. 9(*c*) is a similar view to FIG. 9(*a*), but shows another modification thereof;

Before the description of the present invention proceeds, it is to be noted that like parts are designated by like numerals throughout the several views of the accompanying drawings.

Figure 1:
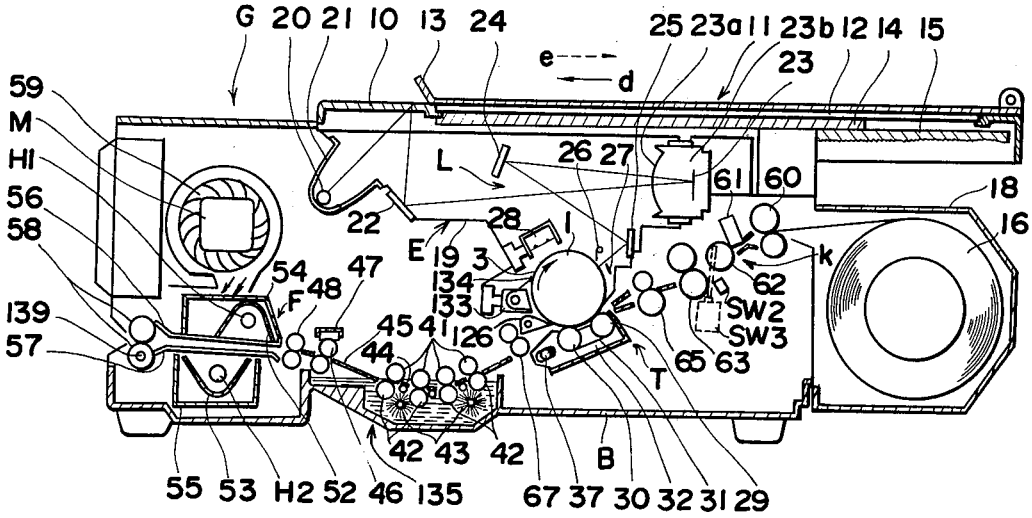
FIG. 1 is a schematic diagram showing a sectional side view of a copying apparatus according to the present invention.

Referring to FIGS. 1 through to 11, the transfer type electrophotographic copying apparatus of the present invention with a movable platform to place an original to be copied thereon generally comprises a drum 1 having a photoreceptor surface 3 on the outer periphery thereof and rotatably mounted on a shaft journaled in the frame of the apparatus housing G to rotate in the direction indicated by an arrow to cause the photoreceptor surface 3 sequentially pass various processing stations disposed therearound, such as a charging station with a corona discharger 28, a slit exposure station associated with a slit exposure device E and a transfer station having a transfer device T. The device also broadly comprises horizontally movable platform 11 provided above the drum 1 and reciprocatingly supported at the upper portion of the housing G, a copy paper feeding device including a plurality of rollers and a copy paper roll 16 rotatably enclosed in a casing 18, a developing device D disposed at the left lower portion of the drum 1, and a drying and fixing device F for copy paper sheets disposed subsequent to the developing device D.

The movable platform 11 on which is placed the original to be copied further includes a frame 10 which has a transparent support platen 12 set therein, for example of glass, a platen cover 13 pivotally secured on the frame 10 so as to cover the platen 12 with the original to be copied therebetween, a pair of guide rails 14 for reciprocating the platform 11 and a rack 15 for transmitting a driving force from a driving means.

The image rays from the original placed on the platform 11 are directed onto the photoreceptor 3 on the drum 1 through the slit exposure device E fixedly provided between the platform 11 and the photoreceptor drum 1.

The slit exposure device E enclosed, for shielding unnecessary light, in an optical frame 19 suitably fixed to the apparatus housing G includes a light source 20, for example, a halogen lamp or fluorescent lamp having a reflecting shade 21 for illuminating the original to be copied, a slit optical system L comprising a first mirror 22 fixedly provided below the platform 11 and inclined at approximately 45° with respect to the lower surface of platform 11 for directing the light rays from the original to a second mirror 23 through a lens 23*a* enclosed in a lens tube 23*b*, and a third mirror 24 fixedly provided immediately below the platform 11 and suitably inclined so as to direct the light rays reflected by the mirror 23 through the lens 23*a* to a fourth mirror 25 secured in the optical frame 19 adjacent to the drum 1, which mirror 25 in turn directs the light images from the original onto the photoreceptor surface 3 through a slit adjusting vane 26 and a plate 27 for eliminating uneven exposure disposed adjacent to the image forming portion on the photoreceptor 3.

It should be noted here that, in the above optical system L, the light path between the first mirror 22 and the second mirror 23 through the lens 23a is adapted to intersect the light path between the third mirror 24 and the fourth mirror 25 so that the space required for the optical system i.e., mainly the distance between the platform 11 and the photoreceptor drum 1, is reduced to a large extent.

The photoreceptor drum 1 has a small diameter, for example, in the range of approximately 50 to 100 mm.

Although the conventional photoreceptor drum had a minimum limit of approximately 120 mm in diameter, the present inventors confirmed that a photoreceptor drum having a small diameter in the range of 50 to 100 mm had an efficient copying performance without any optical distortion of the formed images, after repeated experiments and trial productions, also taking into consideration the relation of the photoreceptor drum to other processing devices mentioned later, which findings contribute much to the reduction of the size of the copying apparatus.

Referring particularly to FIG. 1, the corona charger 28 is fixedly mounted, above the photoreceptor drum 1, adjacent to the electrophotosensitive photoreceptor layer 3 ( FIG. 11 ) on the drum 1 for uniformly charging the layer 3. The image rays from the original to be copied are projected onto the charged layer 3 through the slit exposure device E which sequentially scans the original placed on the platform 11, moving in a scanning direction with a resultant electrostatic latent image corresponding to the image of the original formed on the photoreceptor layer 3.

Figure 3:
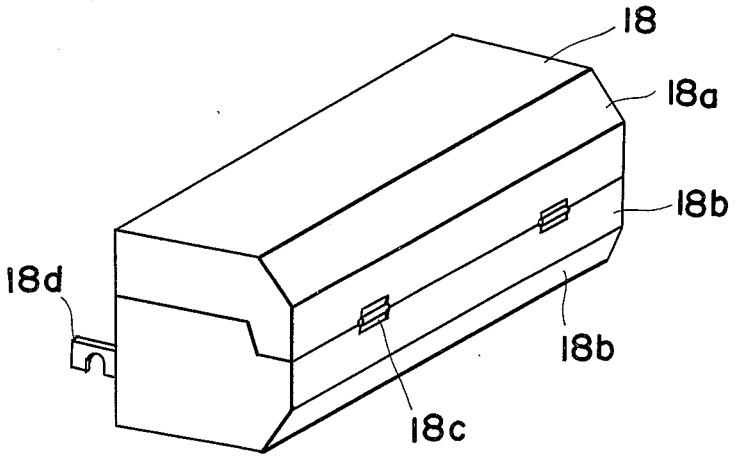
FIG. 3 is a perspective view of a casing for a roll of copy paper employed in the apparatus of FIG. 1 with said casing removed from the copying apparatus.
Figure 4:
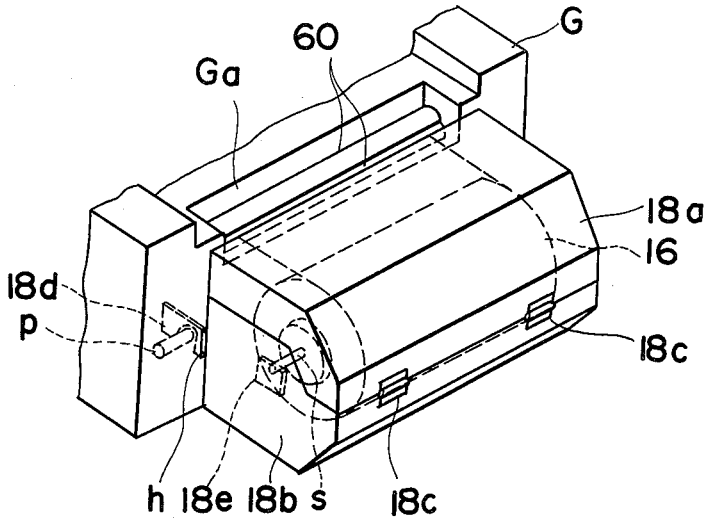
FIG. 4 is a similar view to FIG. 3, but with the casing attached to the copying apparatus.

Referring to FIGS. 3 and 4, a roller 16 of copy paper is rotatably supported in a casing 18 releasably attached to the rear side wall of the apparatus housing G ( FIG. 1 ). The casing 18 made, for example, of transparent plastic material comprises an upper casing 18*a* and an lower casing 18*b* connected together by hinges 18*c* so that the upper casing 18*a* can be raised or lowered about the hinges 18*c*.

It should be noted here that the material for the casing 18 need not necessarily be totally transparent, but may be partially transparent when observed from a proper angle, or semitransparent, or may be simply provided with a suitable opening for confirmation.

A pair of metal pieces 18d for engaging with pins *p* secured to the apparatus housing G are fixedly attached to the opposite side walls of the lower casing 18*b* with one end of each metal piece 18*c* projecting to a certain extent from the edge of the side wall of the lower casing 18*b* facing the housing G.

The casing 18 is adapted to be attached to the apparatus housing G with the projecting ends of the metal pieces 18*d* inserted into openings *h* formed in the corresponding wall of the housing G and subsequently hooked on the pins *p*.

The roll 16 of the copy paper is mounted on a shaft S which is releasably supported by a pair of bearing plates 18*e* secured to the opposite side walls of the lower casing 18*b*.

A pair of first rollers 60 exposed from the apparatus housing G are provided for feeding web of copy paper from the roll 16 into the apparatus G and are partially surrounded by a cover G*a* of the housing G for shielding unnecessary light. When the leading edge of the paper web from the roll 16 is inserted between the first rollers 60, the copy paper is adapted to be continuously fed into the copying apparatus G as the subsequent copying operation begins. If labels showing paper sizes B4, A4, B5 and A5 etc., are affixed on the casing 18, the size of the copy paper sheet can be readily identified by comparing the length of the copy paper sheet with such labels.

As described above, the above casing 18 of the invention is not only capable of confirming the presence and the sizes of the copy paper sheets very easily, but is also very advantageous in reducing the size of the copying apparatus, since the casing 18 is releasably attached to the outer side wall of the apparatus for easy handling.

Moreover, since the roll 16 of the copy paper enclosed in the casing 18 is wound with its photosensitive surface outward, the resultant curling of the copy paper to a certain extent is effective for making it very easy to separate the copy paper sheet from the photoreceptor surface 3 of the drum 1, as will be described later.

Referring back to FIG. 1, the paper web from the roll 16 is fed to the transfer device T through the first rollers 60, a cutting device k having a stationary blade 61 and a rotatory blade 62 for cutting the paper web to a required size, a pair of loop forming rollers 63 for cutting the paper web in a state of tension and another pair of second rollers 65 for feeding the cut copy paper sheet into the transfer device T.

During the above feeding, the copy paper feeding speed of the above loop forming rollers 63 is adapted to be faster than that of the first rollers 60 (actually a speed ratio in the range of 1.05 to 1.2 times is suitable), and a one-way clutch 94 (FIG. 2) is mounted on a shaft of one of the first rollers 60 so that, after the leading edge of the web of copy paper has reached the loop forming rollers 63, the feeding speed of the first rollers 60 follows that of the loop forming rollers 63, in which case the first rollers 60 rotate by the pull of the rollers 63 theough the copy paper sheet.

Furthermore, the feeding speed of the loop forming rollers 63 is adapted to be faster than that of the second rollers 65, whereby the copy paper sheet is fed forming a loop between the rollers 63 and rollers 65.

For cutting the web of copy paper into a copy paper sheet of desired size, the rotations of the first rollers 60 and loop forming rollers 63 are stopped with the roller 65 rotating, by the signal from the paper cut switch SW 6 ( FIG. 12 ) actuated as the platform 11 advances in the direction shown by an arrow *d*, and simultaneously a solenoid $SL_3$ is actuated to turn the rotatory blade 62 so as to cut the web of paper between the rotatory blade 62 and the stationary blade 61.

During the above cutting process, the second rollers 65 keep rotating, whereby the copy paper sheet being fed through the second rollers 65 is continuously fed without stopping because of the presence of the loop formed between the rollers 63 and the second rollers 65. Although the loop forming rollers 63 are not being driven as the first rollers 60 after the web of copy paper has been cut, a one way clutch 93 ( FIG. 2 ) mounted on a shaft of one of the rollers 63 allows the rollers 63 to rotate following the feeding speed of the second rollers 65 through the copy paper sheet after the loop therebetween has disappeared.

A platform lock releasing switch $SW_2$ is disposed behind the cutting device K in such an operating position that, when the copy paper sheet has reached the transfer device T, the position of the copy paper sheet coincides with the position of the latent image formed on the photoreceptor drum 1. When the leading edge of the copy paper sheet reaches the releasing switch $SW_2$, the signal therefrom is adapted to move the platform 11 to form the electrostatic latent image on the photoreceptor surface 3 of the drum 1.

The latent image thus formed is subsequently transferred onto the copy paper sheet which is fed to the transfer device T in synchronization therewith.

Figure 5:
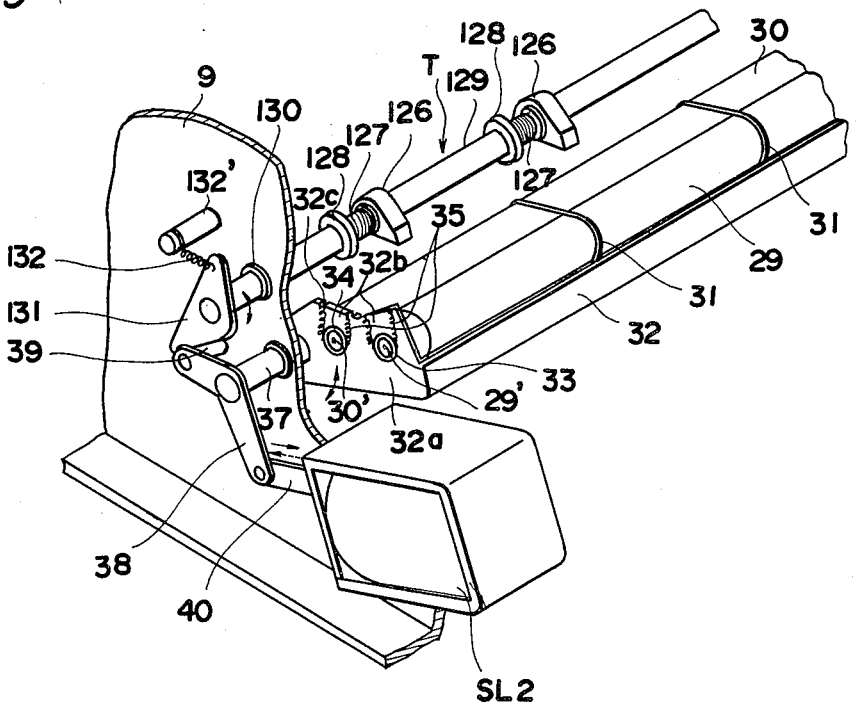
FIG. 5 is a perspective view, on an enlarged scale, of a transfer device and associated mechanism therewith employed in the copying apparatus of FIG. 1.
Figure 6:
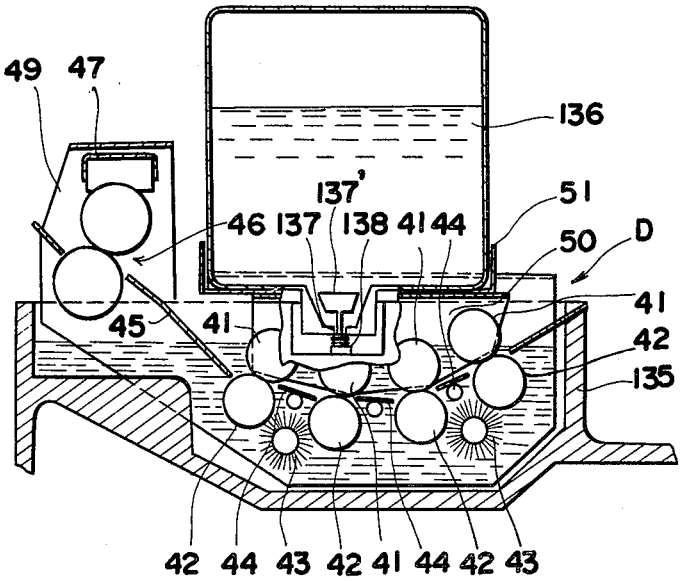

Referring to FIGS. 1 and 5, the transfer device T mainly comprises an electrically insulating roller 29 and a conductive roller 30 rotatably mounted in an arm plate 32, and a plurality of narrow belts 31 connecting the two rollers 29 and 30 for maintaining the adhesion of the copy paper sheet to the photoreceptor surface 3 of the drum 1. The above rollers 29 and 30, which are fixedly mounted on shafts 29' and 30', are rotatably supported by bearings 33 and 34 respectively mounted on upright opposite side walls **32*a* of the arm plate 32. Each of the bearings 33 and 34 is secured to a metal piece 32b slidably received in an elongated slot 32*c* formed in the side wall 32*a* of the arm plate 32 and is suitably urged upward by a spring 35 toward the photoreceptor drum 1 so that the rollers 29 and 30 contact the photoreceptor surface 3 under uniform pressure. The arm plate 32 is fixedly mounted on a shaft 37 which is rotatably supported on the frame 9 through bearings 36. An approximately L shaped lever 38 is secured, at the middle portion thereof, to the end of the shaft 37 extending through the frame 9 with one end of the lever 38 pivotally connected to a plunger 40 of the transfer solenoid $SL_2$. Accordingly, the movement of the plunger 40 of the solenoid $SL_2$ in the direction shown by a real line arrow turns the arm plate 32, through the shaft 37 and the lever 38, toward the photoreceptor drum 1 ( FIG. 1 ) with the rollers 29 and 30 contacting the photoreceptor surface 3. Upon deenergization of the solenoid $SL_2$, the rollers 29 and 30 disengage from the photoreceptor 3 by their own weight and the weight of the arm plate 32 to return to their original position spaced away from the drum 1. The above operation of the arm plate 32 is effected, through the solenoid $SL_2$, by the signals generated by the transfer starting switch $SW_5$ ( FIG. 12 ) and the transfer stopping switch $SW_9$ ( FIG. 12 ) during the reciprocating movement of the platform 11**.

On the other hand, the transfer solenoid $SL_2$ is adapted to function only during the period in which the leading edge of the copy paper sheet has reached the transfer device T and the trailing edge thereof has passed through the transfer device T.

The above insulating roller 29 having an outer surface composed of an insulating material, for example, flexible rubber or sponge functions to keep the copy paper sheet adhered to the photoreceptor surface 3 without any abnormal spark discharge between the photoreceptor surface 3 and the copy paper sheet during the period from the approach of the copy paper sheet to the photoreceptor surface 3 to the adhesion of the former to the latter, especially when the former is located close to the latter. The conductive roller 30 is composed of generally available conductive rubber or of insulating materials such as polyurethane coated or impregnated with an elastic conductive adhesive for electrical conduction, and is intended to effect the electrostatic transfer by electrically connecting the electrode at the back of the photoreceptor layer 3 with the conductive roller 30 contacting the reverse side of the copy paper sheet for effecting shortcircuiting therebetween and consequent grounding.

The surface potential of the electrostatic latent image formed on the photoreceptor surface 3 of the drum 1 is in the range of 800 to 1600 volts. Since the atmospheric discharge can normally be effected at a potential difference of approximate more than 600 volts when the gap between the latent image and the copy paper sheet is in the region from several tens to 100 $\mu$, a latent image corresponding to that on the photoreceptor surface 3 is formed on the copy paper sheet by shortcircuiting and grounding the conductive roller 30 and the electrode at the back of the photoreceptor layer 3, and allowing the copy paper sheet to pass between the conductive roller 30 and photoreceptor layer 3 with the gap as described above therebetween. However, instead of the shortcircuiting and grounding in the above described manner, a bias voltage may be applied to the conductive roller 30 to adjust the above potential for coordinating the reproducibility of the transferred latent image with various conditions of exposure, development, and those depending upon the properties of the photoreceptor layer 3 and the copy paper sheet.

Moreover, the insulating roller 29 is not necessarily in contact with the photoreceptor surface 3, but may be spaced away from the latter during the transfer. In this case no inconvenience will be experienced for the close contact of the copy paper sheet if only the belts 31 are in contact with the photoreceptor surface 3. The transferred copy paper sheet with the latent image formed thereon is separated from the photoreceptor surface 3 against the electrostatic attraction to the latter partly due to the fact that the photoreceptor drum 1 is of a small diameter (approximately 60 mm) and partly because the resilience of the copy paper sheet itself works advantageously. Moreover, since the roll 16 of the copy paper is wound with its photosensitive surface onto which the latent image is to be transferred outward, the copy paper is always fed with its leading edge somewhat turned downward during transportation thereof due to curling of the copy paper while being wound on the roll 16, which curling works against the electrostatic attraction during separation of the copy paper from the photoreceptor surface 3 so as to facilitate the separation. In preparation for a case where the separation may be insufficient because of the adoption of particularly thin copy paper sheets with less resilience than in those commonly used, separating pieces 126 which are adapted to turn in synchronization with the movement of the transfer device T are provided as in FIG. 5, in which there are shown a plurality of separating pieces 126 which are composed of materials with low friction coefficients such as Teflon and which are pivotally disposed at regular intervals on a shaft 129 rotatably supported at bearings 130 by the side walls of the frame 9 of the apparatus G. A ring 128 is fixedly mounted on the shaft 129 adjacent to each of the separating piece 126 with a torsion spring 127 disposed between the ring 128 and the separating piece 126. Since one end of the spring 127 is fixed to the ring 128 with the other end thereof secured to the separating piece 126, the pieces 126 can contact the photoreceptor surface 3 uniformly. On the other hand, a lever 131 in the form of a triangle is fixedly mounted, at the middle portion thereof, to the end of the shaft 129 extending through the frame 9, with a tension spring 132 stretched between one end of the lever 131 and a pin 132' secured on the frame 9, whereby the other end of the lever 131 is urged toward a contact pin 39 fixed to the end of the lever 38 remote from the plunger 40.

Accordingly, upon energization of the transfer solenoid $SL_2$ with the movement of the plunger 40 in the direction of the real line arrow, the lever 38 is turned counterclockwise with the arm plate 32, which, lever 38 simultaneously turns, the lever 131 which in turn causes the separating pieces 126 to rotate through the shaft 129 and the springs 127 with the separating pieces 126 contacting the photoreceptor surface 3 under proper pressure. When the transfer solenoid $SL_2$ is de-energized, the lever 38 turns clockwise together with plate 32 with the lever 131 and the shaft 129 for the separating pieces 126 also rotated clockwise, and consequently the separating pieces 126 leave the photoreceptor surface 3 and return to the original positions.

As described above, since the separating pieces 126 are adapted to pivot in synchronization with the rotation of the rollers 29 and 30, even a thin copy paper sheet is positively separated from the photoreceptor surface 3 and fed into the developing device D ( FIG. 1 ) through a pair of static eliminating rollers 67 provided at an inlet for the developing device D so as to eliminate the static at the reverse side of the copy paper sheet.

Referring back to FIG. 1, after the transfer and separation of the copy paper sheet as described above, the electrostatic charge remaining on the photoreceptor surface 3 is removed by a static eliminating device, for example, by an erasing lamp 133 provided adjacent to the separating pieces 126 subsequently any dust adhering to the photoreceptor surface 3 is wiped off therefrom by a dust removing cloth 134 which is adapted to lightly contact the photoreceptor surface 3.

It should be noted here that, since the phototreceptor drum 1 employed in the apparatus of the invention has a small diameter of approximately 60 mm with the drum 1 adapted to rotate more than once per copying cycle, it is necessary for the whole outer periphery or part of the photoreceptor surface 3 of the drum 1 to be used twice for the latent image formation, transfer and subsequent erasing per every copying except for a case where the size of the image to be copied is particularly small, so that after an initial formation of latent image etc., has been completed, similar processes such as charging, exposure and transfer are repeated until scanning on the whole surface of the original to be copied is finished.

The copy paper sheet separated from the photoreceptor surface 3 is transported into the developing device D through the static eliminating rollers 67, in which case the surface potential of the electrostatic latent image formed by the transfer on the copy paper sheet is comparatively low normally in the range from 60 to 150 volts, though the potential may differ depending on the conditions such as characteristics of the copy paper sheets and the photoreceptor 1, charging potential on the photoreceptor, and the presence of bias voltages during transfer etc., so that a liquid developing means using electrode rollers are advantageously employed in the above case.

Figure 6:
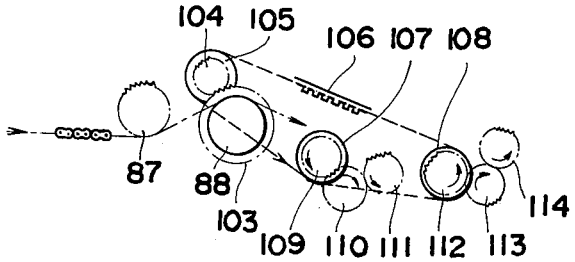
FIG. 6(*a*) is a schematic diagram showing a sectional side view, on an enlarged scale, of a developing device employed in the copying apparatus of FIG. 1.

Referring now to FIG. 6 (*a*), the developing device D of the invention mainly comprises a first developing frame 49 in which there are provided four rotatable lower electrode rollers 42 of metallic material, three guide plates 44 for guiding the copy paper sheet, two cleaning brushes 43 rotatably provided in contact with the electrode rollers, a pair of squeezing rollers 46 for removing developing liquid from the copy paper sheet after developing, a guide plate 45 disposed between the last electrode roller 42 and the squeezing rollers 46, and a cleaner 47 disposed in contact with the upper roller of the rollers 46 for removing toner particles adhering on said upper roller 46, and a second developing frame 50 provided on the first developing frame 49, in which frame 50 four upper electrode rollers 41 of metallic material moveable upward or downward are rotatably provided at positions corresponding to and in contact with the lower electrode rollers 42 of the first frame 49 with a receiving plate 51 for a developing solution supply tank 136 fixedly provided at the upper portion of the frame 50.

The above described first and second developing frames 49 and 50 are releasably received in a developing tank 135 formed integrally with a base plate B of the apparatus housing G (FIG. 1), and when the second frame 50 is mounted on the first frame 49, the upper electrode rollers 41 are adapted to engage the lower electrode rollers 42 under pressure due to the weight of the former.

The lower electrode rollers 42 are adapted to be driven by the driving force transmitted from the driving motor M (FIG. 1) with the upper rollers 41 rotating following the rotation of the lower rollers 42, and the copy paper sheet is transported while being held between the rollers 41 and 42. Each of the above upper electrode rollers 41 is electrically shortcircuited through the first and second developing frames 49 and 50.

Generally, the relation of the field strength in the vicinity of the electrostatic latent image to the distance between electrodes, for example, the distance between a latent image formed surface of a copy paper sheet and an electrode roller or a facing electrode such as an electrode plate is such that the field strength increases to a large extent as the distance between electrodes decreases, while it greatly decreases as the distance between electrodes increases. Accordingly, in a developing means employing electrode rollers, the developing position is limited to be located in the neighborhood of the developing rollers. In the developing device D of the present invention having a construction as described above, optimum developing efficiency due to the large increase of the field strength is achieved with sufficient density of the developed images by the adoption of a plurality of electrode rollers. The cleaning brushes 43 which are adapted to rotate in contact with the electrode rollers 42 are effective not only for preventing soiling at the reverse side of the copy paper sheet by removing developing toner adhering to the surfaces of the rollers 42, but for preventing the lowering of developing efficiency due to precipitation by uniform stirring of the developing solution, since the brushes 43 are rotating in the developing solution, stirring the latter.

The developing solution supply tank 136 releasably received in the receiving plate 51 fixedly mounted on the the second developing frame 50 is provided with an opening 137 for supplying the developing solution at the lower portion thereof, which opening 137 has a stopper plug 137' which is normally urged to the inner edge of the opening 137 by a spring 138 to close the opening 137 with the lower end of the plug 137' projecting from the opening 137.

Accordingly, when the tank 136 is placed in position on the receiving plate 51, the projecting end of the plug 137' and consequently the spring 138, is pressed back with the projecting end of the plug 137' contacting a part of the developing tank 135, and consequently developing solution flows from the supply tank 136 into the developing tank 135. When the level of the developing solution reaches the opening 137, air is prevented from entering the tank 136 and the flow of the developing solution from the tank 136 stopped, and with the supplying of the same finished.

In the mean time, the copy paper sheet developed in the developing solution while passing between the electrode rollers 41 and 42 is transported through the guide plates 44 and 45 to the squeezing rollers 46 disposed immediately above the level of developing solution for removing unnecessary developing solution from the copy paper sheet, and subsequently fed into the drying and fixing device F (FIG. 1). Immediately before entering the drying and fixing device F, the copy paper sheet is again passed through rollers 48 (FIG. 1) of liquid absorbing material for further removing unnecessary developing solution.

Referring back to FIG. 1, the drying and fixing device F of the invention comprises an upper tubular heater $H_1$ and a lower tubular heater $H_2$ disposed along a path of the copy paper sheet for heating and fixing the developed image on the copy paper sheet from both sides thereof, reflecting shades 52 and 53 for the heaters $H_1$ and $H_2$, respectively, for reflecting heat rays therefrom, a fan 59 provided above the heater $H_1$ for directing air flow onto the heated copy paper sheet for drying, casings 54 and 55 surrounding the heaters $H_1$ and $H_2$ for insulating heat from the latter, guide plates 56 and 57 between which the copy paper sheet is to be transported, and a pair of rollers 58 for discharging the copied paper sheet out of the apparatus G.

Accordingly, the developed copy paper sheet with the unnecessary developing solution removed as it passes the liquid absorbing rollers 48 is subsequently passed between the guide plates 56 and 57, in which case the guide plates 56 and 57, especially the latter, are heated by the heat generated by the heater $H_2$, thus serving as a secondary heat generating plate which is effective for improving the fixing of toner by heating the developed copy paper sheet from its reverse side.

The developed copy paper sheet heated to a higher temperature while passing between the guide plates 56 and 57 is further blown by an air flow caused by the fan 59 for expediting evaporation of the developing solution, and the surface of the copy paper sheet is sufficiently dried, thereafter the copied paper sheet being discharged out of the apparataus G through the rollers 58.

Figure 7:
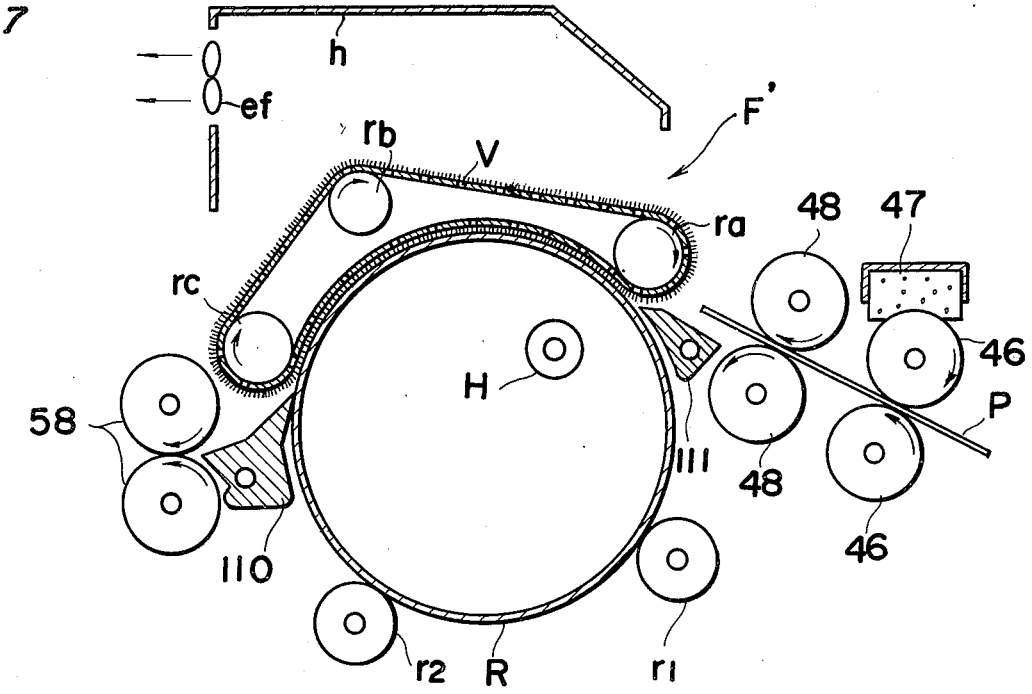
FIG. 7 is a schematic diagram showing a sectional side view, on an enlarged scale, of a modification of a drying and fixing device employed in the copying apparatus of FIG. 1.

Referring FIG. 7, there is shown a 1st modification of the drying and fixing device F of the embodiment in FIG. 1. In this modification, the device F' comprises a hollow cylinder R which is made of good heat transfer material, for example, of aluminum with either the inner periphery of both the inner and outer peripheries thereof treated with black anodized aluminum for better heat transfer. The cylinder R is supported for rotation in the direction of an arrow by two rollers $r_1$ and $r_2$ rotatably provided below the cylinder R. A heater H of suitable type is enclosed in the cylinder R in a position close to an inlet for the wet copy paper sheet *p* adjacent the liquid absorbing roller 48. Flat belt V comprising a sheet material having permeability to air as mentioned later is suspended, so as to be in close contact with the upper surface of the cylinder R, by three rollers $r_a$, $r_b$ and $r_c$ rotatably provided along the upper periphery of the cylinder R so that the belt V contacting the upper surface of the cylinder R is driven following the rotation of the cylinder R at the same peripheral speed.

It is needless to say that the belt V may be separately driven by a suitable independent driving means connected to one of the rollers $r_a$, $r_b$ and $r_c$.

The cylinder R should preferably be of air tight constuction (not shown) so that the air inside the cylinder R is not affected by the external air for maintaining the cylinder R at an optimum temperature for fixing the copy paper sheet with a temperature detector (not shown) of a thermistor or thermocouple incorporated therein.

In FIG. 7, the belt V is employed as a means for bringing the copy paper sheet *p* into close contact with the upper periphery of the cylinder R, and the wet copy paper sheet *p* subjected to development is adapted to pass between the cylinder R and the belt V along the surface of the cylinder R at the same peripheral speed as that of the latter.

A guide pawl 111 for guiding the wet copy paper *p* from the absorbing rollers 48 is provided adjacent to the surface of the cylinder R in a position between the roller $r_a$ for the belt V and the cylinder R close to the inlet for the copy paper sheet *p*.

Similarly, a separating pawl 110 for separating the copy paper sheet *p* transported between the belt V and the cylinder R, and directing the same toward the discharging rollers 58 is pivotally provided in contact with the surface of the cylinder R in a position between the roller $r_c$ for the belt V and the cylinder R and adjacent to the rollers 58 for discharging the fixed copy paper sheet out of the apparatus G.

The guide pawl 111 and the separating pawl 110 should preferably be made of material free from adhesion of toner, for example, fluoroplastics.

By this arrangement, the wet copy paper sheet *p*, the electrostatic latent image on which is visualized by the developing device D, is squeezed by the squeezing rollers 46 equipped with the cleaner 47 and fed between the belt V and the cylinder R after having passed through the absorbing rollers 48 for further absorbing the developing solution remaining in the copy paper sheet. The copy paper sheet thus fed onto the cylinder R is heated (at temperatures approximately 80° to 100°C) by the cylinder R as it passes between the belt V and the cylinder R for drying and fixing, and subsequently delivered out of the apparatus G through the discharge rollers 58. A cover plate *h* and an exhaust fan $e_f$ are further provided above the belt V for driving the vapor and gas due to heating out of the apparatus G.

Figure 8:
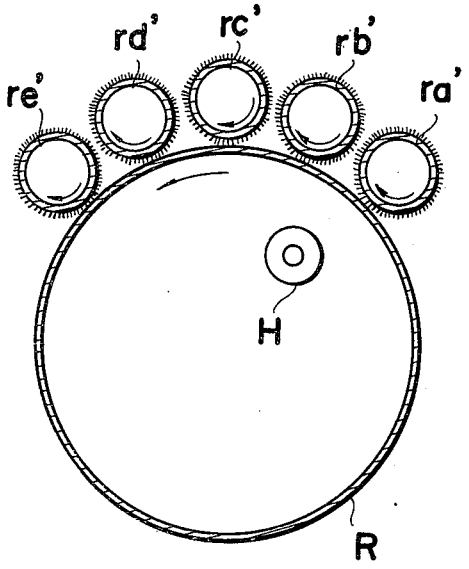
FIG. 8 is a schematic diagram showing a sectional side view, on an enlarged scale, of another modification of a drying and fixing device employed in the copying apparatus of FIG. 1.

Referring now to FIG. 8, there is shown a 2nd modification of the drying and fixing device F of the embodiment in FIG. 1.

In this 2nd modification, five rollers $r_a'$, $r_b'$, $r_c'$, $r_d'$, and $r_e'$ are rotatably provided with spaces therebetween along the upper surface of the cylinder R instead of the belt V and rollers $r_a$, $r_b$ and $r_c$ employed in the 1st modification. The rollers $r_a'$ to $r_e'$ are each adapted to contact the surface of the cylinder R and are disposed to provide necessary contact area between the cylinder R and the wet copy paper sheet *p* to be dried and fixed, with the outer periphery of each of the rollers $r_a'$ to $r_e'$ covered by suitable sheet material having air permeability as mentioned below in a similar manner to the belt V in the 1st modification, so that sufficient permeability to vapor and gas due to heating is available between the rollers $r_a'$ to $r_e'$ and the copy paper sheet *p*.

Figure 9:
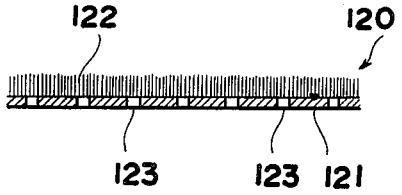
FIG. 9(*a*) is a cross sectional view, on an enlarged scale, of a part of an air permeable sheet material to be applied to the drying and fixing device of FIG. 7 or FIG. 8, FIG. 9(*b*) is a similar view to FIG. 9(*a*), but shows a modification thereof.
Figure 9:
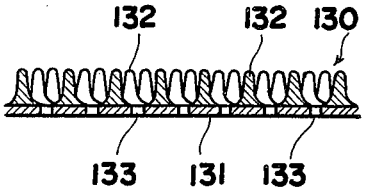
Figure 9:
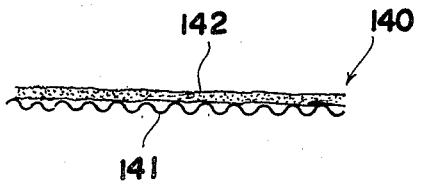

Referring to FIGS. 9(*a*), (*b*), and (*c*), there are shown modifications of the air permeable sheet materials to be applied to the drying and fixing devices of the above 1st and 2nd modifications in FIGS. 7 and 8.

The sheet material 120 shown in FIG. 9(*a*) is equivalent to one employed in the belt V in FIG. 7 and comprises a flexible base 121 of any suitable material, such as leather, synthetic resin sheet, woven fabric, rubber sheet, metal sheet and wire meshe etc., and brush bristles 122 of any heat and abrasion resistant material such as synthetic fiber, natural fibers of cotton or animal fur which are suitably secured on the entire upper surface of the base 121 with many ventilation boles 123 formed in the base 121 if the latter lacks air permeability.

The above brush bristles 122 render the surface of the sheet material 120 a non-smooth contact surface with the tips of the brush bristles 122 contacting the corresponding points on the entire surface of the wet copy paper sheet *p*, thereby forming small spaces for ventilation which allow the vapor to flow between the sheet material 120 and the copy paper sheet *p*, and consequently the vapor is dissipated through the ventilation holes 123 formed in the base 120.

If the sheet material 120 as described above is applied on the surface of the rollers $r_a'$, to $r_e'$ in the 2nd modification of the drying and fixing device F in FIG. 8, the ventilation holes 123 employed in FIG. 9(*a*) may not necessarily be formed since contact surface between the rollers $r_a'$ to $r_e'$ and the wet copy paper sheet *p* is small and the vapor and gases generated by heat are exhausted upward through the spaces between the neighboring rollers $r_a'$ to $r_e'$.

In the sheet material 130 shown in FIG. 9(*b*), many wart-like protrusions 132 of flexible materials such as rubber and synthetic resins are formed on base 131 with the spaces between the neighboring protrusions 132 adapted to be sufficient to store and flow the vapor from the wet copy paper. Similarly to the sheet material 120 described in FIG. 9(*a*), many ventilation holes 133 should be formed if the sheet material 130 is applied to the belt V in FIG. 7, which holes 133 need not necessarily be formed in the base 131 if the sheet material 130 is to be used for the rollers $r_a'$ to $r_e'$ in FIG. 8 or the base 131 is made of air permeable material.

The sheet material 140 shown in FIG. 9(*c*) comprises a base 141 of woven fabrics or mesh cloth having a felt layer 142 formed on the upper surface thereof.

It should be noted that the above described sheet material can further be modified to suit the purpose. For example, the felt layer 142 or the brush bristles 122 as described above may be directly formed on the rollers $r_a'$ to $r_e'$ of the device F in FIG. 7, or a single sheet of a nonwoven fabric can be used for a sheet material instead of the construction of the base 141 and felt layer 142 described in FIG. 9(*c*).

According to the experiments carried out by the present inventors, the above described brush bristles 122 in FIG. 9(*a*), the wart-like protrusions 132 in FIG. 9(*b*) and the felt layer 142 in FIG. 9(*c*) for forming the upper surfaces of the sheet materials 120, 130 and 140 into nonsmooth contact surfaces so as to provide small spaces for ventilation between the belt V or the rollers $r_a'$ to $r_e'$ and the wet copy paper sheet *p* should be composed of flexible materials. If any hard materials are employed, it is impossible to avoid the so-called offset effect when such hard materials contact the surface of the copy paper sheet. On the other hand, if the non-smooth contact surfaces are formed of flexible materials as described above, such flexible materials need not be of ones free from the adhesion of toner such as tetrafluoroethylene, and the offset effect can be eliminated to such an extent that no inconvenience is practically experienced in actual use even when the flexible materials are of natural fibers to which the toner tends to adhere.

Furthermore, the treatment of the inner or both inner and outer peripheries of the cylinder R with black anodized aluminum is effective for absorbing the heat from the heater H into the cylinder R with consequent increase of thermal efficiency for heating the wet copy paper sheet to a large extent.

Likewise, by providing the heater H in positions shown in FIGS. 7 and 8 with the thickness of the hollow cylinder R less than 2 mm, the time required for the device to be ready for operation can be advantageously reduced for efficient heating of the copy paper sheet *p*, which arrangement does not limit the position of the heater H or the number of the heaters involved, but can be modified to suit the purpose of the invention in various ways.

It is another advantage of the drying and fixing device described above that, since the surface of the belt V or the rollers $r_a'$ to $r_e'$ for allowing the copy paper sheet to closely contact the surface of the cylinder R is formed into the non-smooth contact surface which contacts the entire surface of the copy paper sheet *p* in the form of many points with spaces formed between the belt or the rollers and the copy paper sheet, no uneven heating of the copy paper sheet is caused, thus remarkably increasing the drying and fixing efficiency with uniform heating over the entire surface of the copy paper sheet, and without any spoiling of the copied images due to the offset effect and consequently the cost for copying can be reduced to a large extent.

Figure 10:
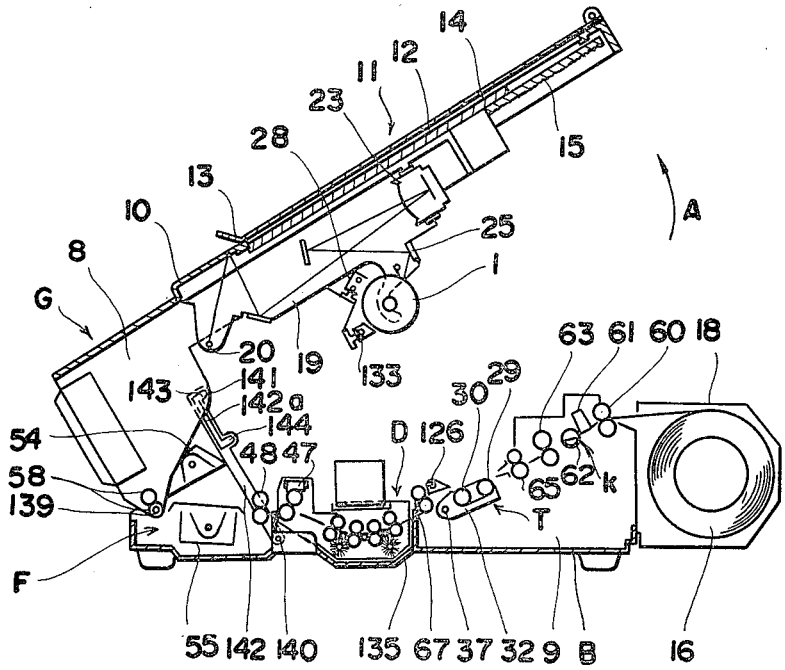
FIG. 10 is a similar view to FIG. 1, but particularly shows the construction of the housing of the copying apparatus with an upper frame thereof in its raised position.

Referring now to FIG. 10, the apparatus housing G of the invention is divided into two portions, i.e., an upper frame 8 and a lower frame 9 with the upper frame 8 pivotally connected to the lower frame 9 by the same shaft 139 as for the lower discharging roller 58 rotatably mounted on the lower frame 9. The pivotal connection permits the upper frame 8 to be raised about the shaft 139 in the direction shown by an arrow A or lowered to combined the frames 8 and 9 into one housing G. For supporting the upper frame 8 in the raised or lowered position, there are provided a stopper pin 141 secured to the side wall of the upper frame 8 and a lever 142 pivotally connected at the lower end thereof to the lower frame 9 by a pin 140. The lever 142 is provided at the upper portion thereof with an elongated U-shaped groove 142*a* in which the pin 140 is slidably received. The groove 142 is further provided with upper and lower bent portions 143 and 144 which work as stoppers for supporting the pin 140. Accordingly, when the pin 140 is slid into the upper bent portion 143 of the groove 142*a*, the upper frame 8 is kept at its raised position, and the frame 8 is locked at its closed position, combined with the lower frame 9 when the pin 141 is slid into the lower bent portion 144 of the groove 142*a*. The platform 11, the optical frame 19, the photoreceptor drum 1, the corona charger 28, an erasing lamp 133 and the upper casing 54 including the heater $H_1$ for the drying and fixing device, are mounted on the upper frame 8, while the releasable casing 18 including the roll 16 of copy paper, rollers 60, the paper web cutting device *k* including the stationary blade 61 and rotatory blade 62, the rollers 63 and 65, the transfer device T, the separating piece 126, rollers 67, the developing device D received in the developing tank 135, rollers 48, the lower casing 55 including the heater $H_2$ for the drying and fixing device F, and rollers 58 etc., are disposed on the lower frame 9 along the path of the copy paper sheet.

Although in FIG. 10, the drum 1 is shown as mounted on the upper frame 8, it is preferable from the view point of simplification of the driving engagement that the drum 1 be included on the side of the lower frame 9.

Figure 11:
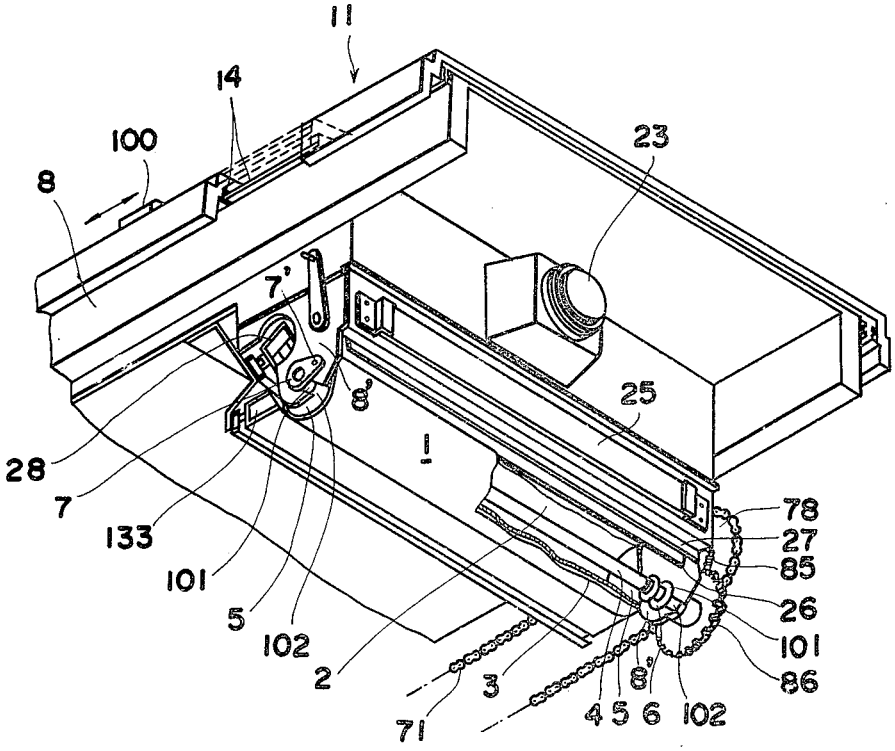
FIG. 11 is a perspective view, on an enlarged scale, of a photoreceptor drum and associated mechanisms therewith employed in the copying appratus of FIG. 1.

Referring to FIG. 11, the photoreceptor drum 1 rotatably mounted on the upper frame 8 comprises a cylindrical drum 2 of electrocondrctive material, for example, aluminum, a pair of disks 5 forming side walls of the drum 2 and a shaft 4 on which the drum 2 is fixedly mounted.

A thin layer of amorphous selenium approximately less than 1 $\mu$ thickness is deposited on the outer periphery of the drum 2, which layer is further coated with an electrophotosensitive layer of polyvinyl carbazole approximately 20 $\mu$ in thickness to form a composite photoreceptor surface 3. It is needless to say that conventional photoreceptors of non-crystalline selenium, cadmium sulfide or zinc oxide may be used instead of the above composite photoreceptor 3.

A gear 86 for driving the photoreceptor drum 1 is fixedly provided on one end of the shaft 4 for transmitting the driving force to the drum 1 to rotate the same in the clockwise direction in FIG. 1 during operation thereof. The photoreceptor drum 1 is adapted to be replaced in the manner described below.

The shaft 4 for the drum 1 is supported at ends thereof by a pair of bearings 6 fitted in openings 101 with notched portions 102, which opening 101 are formed on the opposite depending sides 8' of the upper frame 8 with the bearings 6 prevented from axial movement thereof by a pair of bearing cases 7 releasably attached to the outer surfaces of the depending sides 8' of the upper frame 8 by securing screws 7'. When replacing the drum 1, the bearing cases 7 are removed by loosening the screw 7', the shaft 4 is axially moved to detach the bearings 6 from the openings 101 and subsequently the shaft 4 can be drawn out through the notches 102 for removal of the drum 1.

Figure 2:
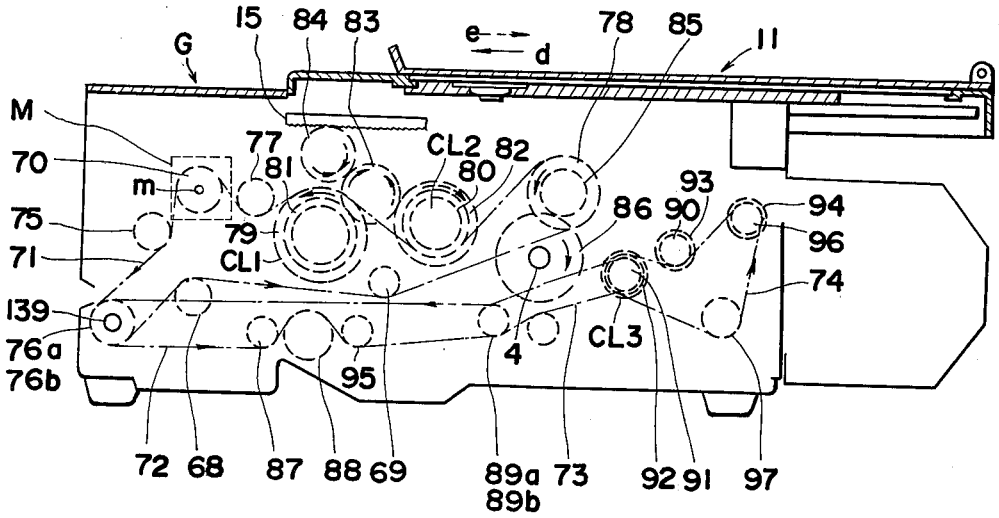
FIG. 2 is a similar view to FIG. 1, but particularly shows driving systems thereof.

Referring now to FIG. 2, driving systems of the copying apparatus of the invention are described hereinbelow.

The driving system mainly comprises a platform driving system, a developing device driving system and a copy paper sheet feed driving system which are disposed in the upper and lower frames 8 and 9 of the apparatus G.

In the platform driving system, a sprocket 70 is fixedly mounted on a driving shaft *m* of the motor M and the driving force of the motor M is transmitted from the sprocket 70, through a chain 71 for moving the platform 11, to an idle sprocket 75, a discharge roller sprocket 76*a*, idle sprockets 68 and 69, a photoreceptor drum sprocket 78, a platform returning clutch sprocket 80, a platform advancing clutch sprocket 79, and an idle sprocket 77, each of which being rotatably mounted on the frame of the apparatus G. The advancing clutch sprocket 79 mentioned above is further provided with an advancing clutch gear 81 through a clutch $CL_1$ for advancing the platform 11, while a returning clutch gear 82 is attached to the returning clutch sprocket 80 through a clutch $CL_2$ for returning the platform 11. The rotations of the above advancing clutch gear 81 and the returning clutch gear 82 are transmitted to the rack 15 secured to the movable frame 10 (FIG. 1) of the platform 11 through an idle gear 83 and a pinion 84 for reciprocating the platform 11. In FIGS. 1 and 2, the advancing of the platform 11 is shown by an arrow *d* and the returning thereof is denoted by an arrow *e*.

A photoreceptor drum driving gear 85 is fixedly mounted on the same rotatable shaft as the photoreceptor sprocket 78, which gear 85 is adapted to mesh with the photoreceptor gear 86 which is fixedly mounted on the shaft 4 of the photoreceptor drum 1 for the rotation of the drum 1.

In the developing device driving system, the shaft 139 for the lower discharge roller 58, which shaft 139 is also used for pivotal connection for the upper frame 8 to the lower frame 9 of the apparatus G (FIG. 10), is further provided with two discharge roller sprockets 76*a* and 76*b* fixedly mounted thereon, one of which sprockets 76*a* is connected to the chain 71 for reciprocating the platform 11 as described earlier, while the other sprocket 76*b* is connected to a developing device driving chain 72 which is directed over a liquid absorbing roller sprocket 87, a developing device driving sprocket 88, an idle sprocket 95 and a static eliminating roller sprocket 89 for transmitting the driving force to the latter.

Accordingly, the discharge roller sprocket 76*a*, the liquid absorbing roller sprocket 87 and the developing device driving sprocket 88 drive the discharge roller 58, the liquid absorbing roller 48 and the developing device D (FIG. 1), respectively.

Referring to FIG. 6(*b*), a developing device driving gear 103 which is fixed on the same shaft as the developing device driving sprocket 88 drives the squeezing rollers 46 (FIG. 1) through a squeezing roller gear 104 and also drives a timing gear 105 mounted on the same shaft as the squeezing roller gear 104. A timing belt 106 is directed over the timing gear 105, a timing gear 107 and a timing gear 108 to drive the gears 107 and 108. Since an electrode roller gear 109 fixed on the same shaft as the timing gear 107 meshes with a cleaning brush gear 110 which in turn engages an electrode roller gear 111 while an electrode gear 112 secured on the same shaft as the timing gear 108 meshes with a cleaning brush gear 113 which in turn engages an electrode roller gear 114, the driving force is transmitted to the electrode roller 42 and the cleaning brushes 43 (FIG. 6(*a*)) respectively.

Referring back to FIG. 2, in the copy paper sheet feed driving system, two static eliminating roller sprockets 89*a* and 89*b* are mounted on the shaft for one of the static eliminating rollers 67 (FIG. 1), one of which sprockets 89*a* is connected to the developing device driving chain 72 mentioned earlier, while the other sprocket 89*b* is connected to a copy paper sheet feed driving chain 73 which is directed over a copy paper sheet feed clutch sprocket 91 for driving the same. A copy paper sheet feed clutch $CL_3$ and a copy paper sheet feed clutch sprocket 92 are mounted on the same shaft as the sprocket 91, through which clutch $CL_3$ the driving force is transmitted to the sprocket 92. It is to be noted that the sprocket 91 mentioned above is fixedly mounted on the same shaft as one of the rollers 65 (FIG. 1) for simultaneous rotation therewith during the operation of the latter. A copy paper sheet feed chain 74 is directed over the above copy paper sheet feed clutch sprocket 92, an idle gear 97, a first roller sprocket 96 and a loop forming roller sprocket 90 for transmitting the driving force to the gear 97, and the sprockets 96 and 90. Mechanical one-way clutches 93 and 94 are mounted on the same shafts as the sprockets 90 and 96 respectively, through which clutches 93 and 94 the driving force is transmitted to the loop forming roller 63 and the first roller 60 (FIG. 1). It should be noted that the one-way clutch 94 is adapted to function in such a manner that the first rollers 60 rotate following the rotation of the loop forming roller 63 through the copy paper sheet, while the one-way clutch 93 functions so that the loop forming rollers 63 or the first rollers 60 rotate following the rotation of the second rollers 65 through the copy paper sheet as described earlier.

Figure 12:
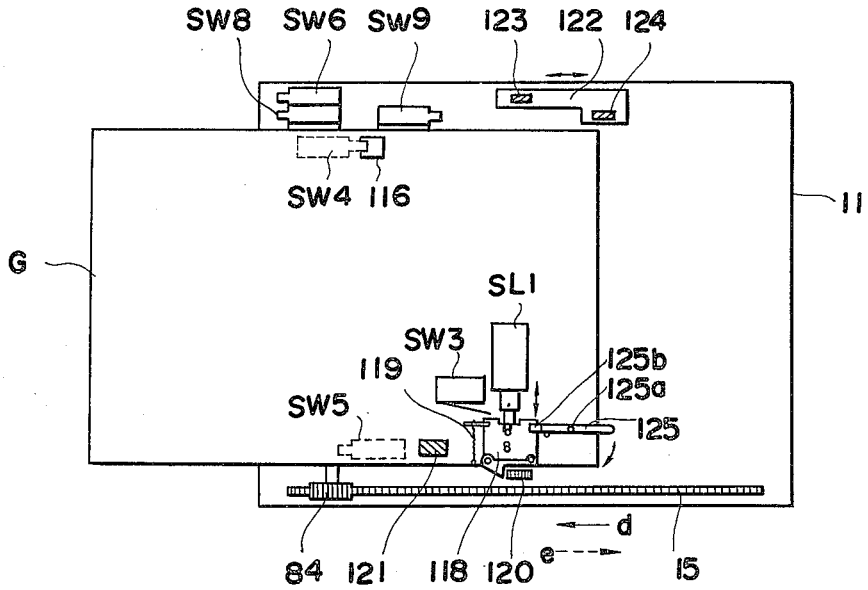
FIG. 12 is a schematic diagram particularly showing positions of various switches and corresponding actuating projections as observed from the lower side of the apparatus in FIG. 1.

Referring now to FIG. 12, positions of switches for the control of the copying apparatus of the invention associated with the reciprocation of the platform 11 as observed from the underside of the upper frame 8 of the apparatus housing G are described hereinbelow.

Microswitches to be actuated by the reciprocation of the platform 11, such as a platform advancing switch $SW_3$, a platform returning stopping switch $SW_4$, a transfer starting switch $SW_5$, a copy paper cut switch $SW_6$, a platform returning switch $SW_8$ and a transfer stopping switch $SW_9$ are mounted on the housing side of the apparatus G, while corresponding projections 120, 116, 121, 123 and 124 for actuating the above microswitches $SW_3$, $SW_4$, $SW_5$, $SW_6$, $SW_8$ and $SW_9$ are fixed on the platform side 11.

In FIG. 12, the platform 11 is in the starting position for copying operation, in which state the platform returning stopping switch $SW_4$ is depressed by the projection 116.

The projecting plate 122 slidably mounted at one side of the platform 11 is set at a predetermined position corresponding to the required length of the original to be copied in association with a random cutting knob 100 (FIG. 11) provided on one side edge of the platform 11 for cutting the web of copy paper into a length corresponding to that of the original.

Upon starting of the copying operation, when the copy paper sheet actuates the switch $SW_2$ for releasing the locking of the platform 11 (FIG. 1), the solenoid $SL_1$ for releasing the locking of the platform 11 is energized. Since the solenoid $SL_1$ is connected to a slidable locking plate 118 which is urged to a locking projection 120 fixed to the platform 11 by a spring 119 for stopping the platform 11, the energization of the solenoid $SL_1$ pulls the plate 118 away from the projection 120 against the force of the spring 119 with the plate 118 disengaged from the projection 120. Simultaneously, the one edge of the plate 118 thus pulled is adapted to depress and actuate the switch $SW_3$ for advancing the platform 11, the signal from which switch $SW_3$ in turn operates the clutch $CL_1$ for advancing the platform 11 (FIG. 2) with the platform 11 starting to move in the advancing direction indicated by the arrow *d* in FIG. 1.

When the switch $SW_5$ for starting the transfer is first depressed by the projection 121 as the platform 11 advances, the solenoid $SL_2$ (FIG. 5) for transfer is actuated with the rollers 29 and 30 for the transfer device T (FIG. 1) contacting the photoreceptor drum 1.

Subsequently, when the projection 123 on the projecting plate 122 depresses the paper cut switch $SW_6$ as the platform 11 advances, the cutter solenoid $SL_3$ (FIG. 1) is energized to rotate the rotatory blade 62 for cutting the web of copy paper as described earlier. When the projection 124 fixed on the plate 122 depresses the switch $SW_8$ for returning the platform 11 after passing over the switch $SW_9$ for stopping the transfer, the clutch $CL_1$ (FIG. 2) for advancing the platform 11 stops functioning with the clutch $CL_2$ (FIG. 2) for returning the platform 11 operated for the platform 11 to start returning movement.

During the returning movement of the platform 11, the depression of the switch $SW_9$ by the projection 124 causes the transfer solenoid $SL_2$ to be de-energized with the rollers 29 and 30 of the transfer device T leaving the photoreceptor drum 1.

Consequently, the platform 11 returns to the original starting position, in which case the projection 116 depresses the switch $SW_4$ for stopping returning of the platform 11, the signal from which switch $SW_4$ de-energizes the clutch $CL_2$ for returning the platform 11.

In the above state, the platform 11 remains stationary until the next copying is started.

A lever 125 for releasing the locking of the platform 11 is to be used when it is necessary to manually release the locking of the platform 11, and is rotatably attached at the middle portion thereof by a pin 125*a* to the housing G at a position adjacent to the locking plate 118 with one end 125*b* of the lever 125 pivotally connected to one corner of the plate 118. Upon turning the free end of the lever 125 about the pin 125*a*, the locking plate 118 is moved to leave the projection 125, enabling the platform 11 to be freely moved manually in the advancing direction thereof.

Figure 13:
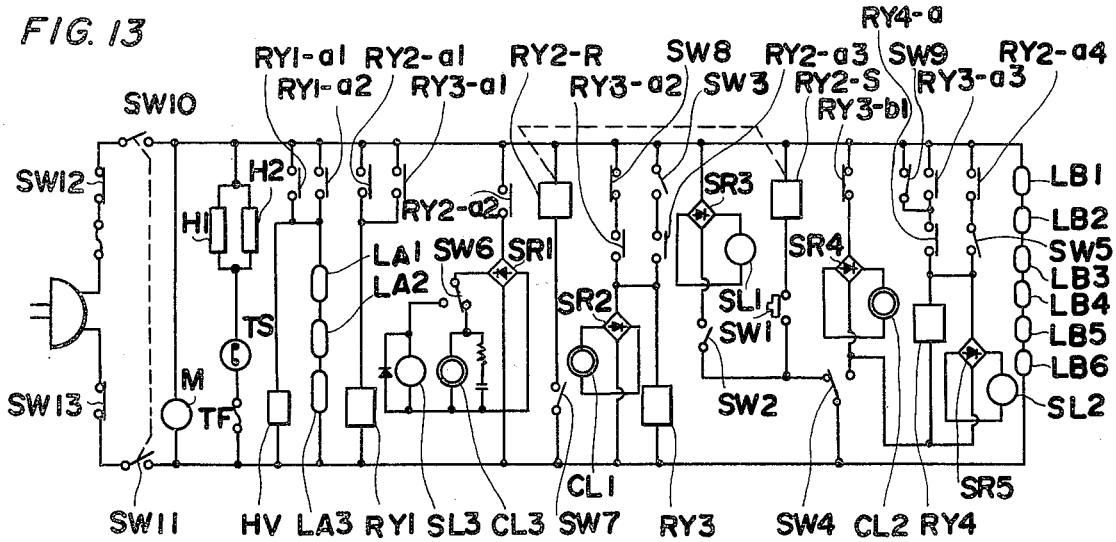
FIG. 13 is an electrical circuit diagram illustrating various elements of the copying apparatus according to the present invention.
Figure 14:
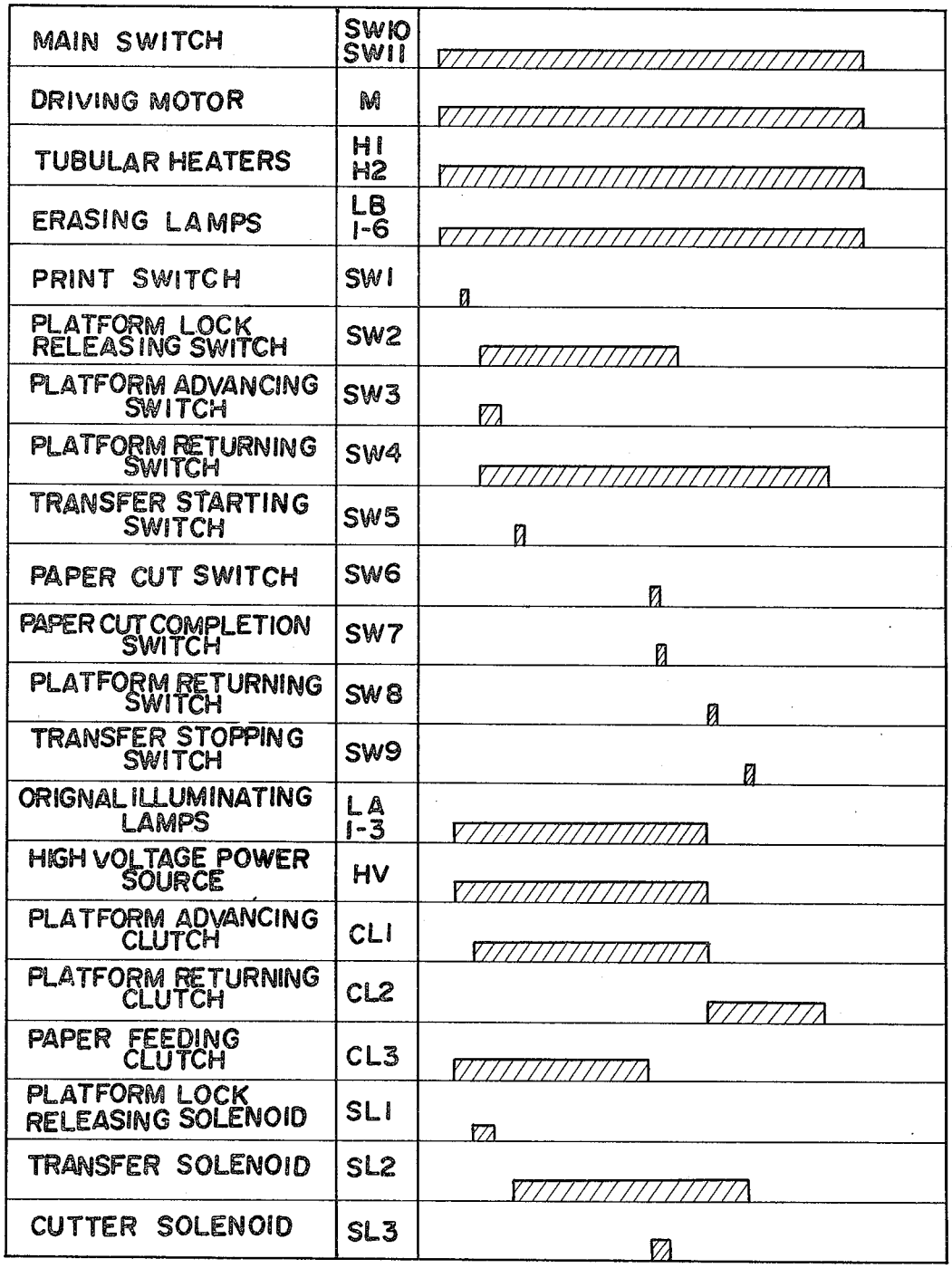
FIG. 14 is a timimg chart showing the sequence of operation for the copying apparatus of the present invention.

Referring to FIGS. 13 and 14, the control mechanism of the copying apparatus of the invention is described hereinbelow.

In FIG. 13, there is shown an A.C. circuit comprising main switches $SW_{10}$ and $SW_{11}$, the driving motor M, the tubular heaters $H_1$ and $H_2$ for drying and fixing, a thermal fuse TF for protecting the drying and fixing device, a thermostat TS for temperature control, a high voltage power source HV, lamps $LA_1$, $LA_2$ and $LA_3$ constituting the light source 20 (FIG. 1) for illumination, a lamp relay $RY_1$, the cutter solenoid $SL_3$, the copy paper feeding clutch $CL_3$, the paper cutting switch $SW_6$ also used for providing instruction to stop feeding of copy sheets, rectifiers $SR_1$ to $SR_5$, latching relays $RY_2$-R and $RY_2$-S, a switch $SW_7$ for completion of copy paper cutting, the clutch $CL_1$ for advancing the platform 11, a relay $RY_3$, the switch $SW_2$ for releasing the locking of the platform 11, the switch $SW_8$ for reciprocating the platform 11, the solenoid $SL_1$ for releasing the locking of the platform 11, the switch $SW_3$ for advancing the platform 11, a print switch $SW_1$, the clutch $CL_2$ for returning the platform 11, the switch $SW_4$ for stopping the returning of the platform 11, a relay $RY_4$, the transfer solenoid $SL_2$, the switch $SW_5$ for starting the transfer, the switch $SW_9$ for stopping the transfer, and lamps $LB_1$ to $LB_6$ constituting the erasing lamp 133 (FIG. 1), all of which are connected to one another to form said A.C. circuit.

The normally open main switches $SW_{10}$ and $SW_{11}$ are each connected in series with a normally closed safety switch $SW_{12}$ or $SW_{13}$ provided at the front door of the apparatus G or other suitable portions of the apparatus G which can be opened or closed.

When the above main switches $SW_{10}$ and $SW_{11}$ are closed upon depression, the driving motor M, the tubular heaters $H_1$ and $H_2$ for drying and fixing, and lamps $LB_1$ to $LB_6$ are energized, and the driving systems, including the copy paper transportation mechanisms except for the first rollers 60 and loop forming rollers 63 (FIG. 1), which are associated with starting of paper feeding, and the photoreceptor drum 1 are driven by the rotation of the driving motor M and continue to rotate while the main switches $SW_{10}$ and $SW_{11}$ are closed.

Since the thermostat TS for controlling temperature which is mounted on the drying and fixing device F controls the supply of current to the heaters $H_1$ and $H_2$, the temperature in the drying and fixing device F is kept at a constant level. The lamps $LB_1$ to $LB_6$ constituting the erasing lamp 133 (FIG. 1) are adapted to be "on" while the main switches $SW_{10}$ and $SW_{11}$ are closed for erasing the electrostatic charge on the surface of the photoreceptor drum 1. After the above described preparation for the copying, the printing switch $SW_1$ is closed upon depression of a print button (not shown). On the other hand, since the platform 11 is in its starting position, the switch $SW_4$ for stopping the returning of the platform 11 is actuated with the movable contact thereof closed to the side of the printing switch $SW_1$ and accordingly, the latching relay $RY_2$-S (set coil) is energized upon closure of the printing switch $SW_1$ with the contacts $RY_2$-$a_1$, $RY_2$-$a_2$, $RY_2$-$a_3$, and $RY_2$-$a_4$ of the relay $RY_2$-S closed. Upon closure of the contact $RY_2$-$a_1$, the lamp relay $RY_1$ is energized and the lamps $LA_1$, $LA_2$, and $LA_3$ for illuminating the original are lit through the contacts $RY_1$-$a_1$ and $RY_1$-$a_2$ of the relay $RY_1$ with the high voltage power source HV connected in parallel to the lamps $LA_1$ to $LA_3$ functioning simultaneously. When the contact $RY_2$-$a_2$ of the relay $RY_2$-S is closed, the rectifier $SR_1$ is energized with the paper feeding clutch $CL_3$ (FIG. 2) actuated through the paper cutting switch $SW_6$ this last switch is normally closed to the side of the clutch $CL_3$ except when the web of paper is to be cut, and this causes the first rollers 60 and loop forming rollers 63 (FIG. 1) to rotate to feed the copy paper sheet to the photoreceptor drum 1.

When the leading edge of the copy paper sheet reaches the switch $SW_2$ for releasing the locking of the platform 11 as the copy paper sheet advances, the switch $SW_2$ is closed to actuate the solenoid $SL_1$ for releasing the locking of the platform 11. Upon actuation of the solenoid $SL_1$, the plate 118 (FIG. 12) for locking the platform 11 is moved to actuate the switch $SW_3$ (FIG. 12) for advancing the platform 11 as described earlier, and the relay $RY_3$ is energized through the contact $RY_2$-$a_3$ closed by the actuation of the latching relay $RY_2$.

The energization of the relay $RY_3$ causes the contacts $RY_3$-$a_1$, $RY_3$-$a_2$ and $RY_3$-$a_3$ thereof to be closed with the contact $RY_3$-$b_1$ opened. The relay $RY_3$ is kept energized and self-retained by the closure of the contact $RY_3$-$a_2$ thereof through the normally closed switch $SW_8$ for returning the platform 11.

Simultaneously, the clutch $CL_1$ for advancing the platform 11, which is connected in parallel with the relay $RY_3$, is actuated for transmission of the driving force from the driving system to the platform 11, and the platform 11 starts advancing.

As the platform 11 starts advancing, the switch $SW_4$ for stopping the returning of the platform 11, which is depressed by the projection 116 (FIG. 12), is released from its depressed condition with the moving contact of the switch $SW_4$ switched from the side of the switch $SW_2$ for releasing the locking of the platform 11 over to the side of the clutch $CL_2$ for returning the platform 11. The solenoid $SL_1$ for releasing the locking of the platform 11 is thus de-energized with the locking plate 118 (FIG. 12) returning to the original locking position. It should be noted, however, that the platform 11 is actually locked only when it has returned to its original starting position.

Although the switch $SW_2$ for releasing the locking of the platform 11 is adapted to open its contact when the above locking plate 118 for the platform 11 has returned to its original position, the relay $RY_3$ and the clutch $CL_1$ for advancing the platform 11 continue to be operated since the relay $RY_3$ is self-retained by the closure of the above contact $RY_3$-$a_2$ thereof.

As the platform 11 advances further, the switch $SW_5$ for starting the transfer is depressed with the contact thereof closed, and the relay $RY_4$ is energized through the contact $RY_2$-$a_4$ which is closed by the action of the latching relay-$RY_2$. Simultaneously the transfer solenoid $SL_2$ connected in parallel to the relay $RY_4$ through the rectifier $SR_5$ is energized.

Upon energization of the relay $RY_4$, the contact $RY_4$-a thereof closed and the relay $RY_4$ is self-retained to be kept energized through the contact $RY_3$-$a_3$ which is closed by the action of the relay $RY_3$ with the transfer solenoid $SL_2$ kept functioning.

A further advancement of the platform 11 actuates the paper cutting switch $SW_6$ with the movable contact thereof switched over to the side of the paper feed clutch $CL_3$. Accordingly, the clutch $CL_3$ stops functioning with the rotation of the first rollers 60 and loop forming rollers 63 stopped, and simultaneously the cutter solenoid $SL_3$ is energized to operate the cutting device k (FIG. 1) including the stationary blade 61 and the rotatory blade 62 for cutting the web of copy paper. In this case the switch $SW_7$ for confirming the completion of normal operation of the rotatory blade 61 is actuated with the contact thereof closed.

Upon closure of the cotact of the switch $SW_7$, the latching relay $RY_2$-R (re-set coil) is energized, and through the consequent actuation of the latching relay $RY_2$-S (set coil), each of the closed contacts $RY_2$-$a_1$, $RY_2$-$a_2$, $RY_2$-$a_3$ and $RY_2$-$a_4$ is opened back into the original condition.

A further advancing of the platform 11 actuates the switch $SW_8$ for returning the platform 11 to open the contact thereof, whereby the self-retained relay $RY_3$ and the clutch $CL_1$ for advancing the platform 11 are de-energized.

Accordingly, the self-retaining of the relay $RY_3$ is released for the relay $RY_3$ to stop functioning, and consequent closure of the contact $RY_3$-$b_1$ of the relay $RY_3$ actuates the clutch $CL_2$ for returning the platform 11 through the actuation of the switch $SW_4$ for stopping the returning of the platform 11, and the platform 11 starts returning.

Simultaneously, the contacts $RY_3$-$a_1$, $RY_3$-$a_2$ and $RY_3$-$a_3$ are opened, and the opening of the contact $RY_3$-$a_1$ de-energizes the lamp relay $RY_1$ with the contacts $RY_1$-$a_1$ and $RY_1$-$a_2$ thereof opened, whereby the lamps $LA_1$, $LA_2$ and $LA_3$, constituting the light source 20 for illuminating the original to be copied, are turned off and the high voltage power source HV is also de-energized.

With the returning of the platform 11, the switch $SW_9$ for stopping the transfer is actuated with the contact thereof opened.

In the above state, the contact $RY_3$-$a_3$ connected in parallel with the above switch $SW_9$ has already been opened, and the relay $RY_4$ and the transfer solenoid $SL_2$ are energized through the switch $SW_9$ for stopping transfer. The opening of the contact of the switch $SW_9$ as described above releases the relay $RY_4$, with both the relay $RY_4$ and the transfer solenoid $SL_2$ ceasing to function. When the platform 11 has further returned back to the original starting position, the switch $SW_4$ for stopping the returning of the platform 11 is actuated to de-energize the clutch $CL_2$ for returning the platform 11, with the platform 11 remaining stationary at the original starting position thereof.

In the case of continuous copying, the printing switch $SW_1$ is kept closed, and by the energization of the latching relay $RY_2$-S through the switch $SW_4$ for stopping the returning of the platform 11 every time the platform 11 returns to the original starting position, the above described copying operation is repeated, which copying operation can be stopped by opening the printing switch $SW_1$ after the copying operation for the last copy paper sheet has started. For effecting the continuous copying described above, conventional counters for setting the number of copies to be made can be employed.

Figure 15:
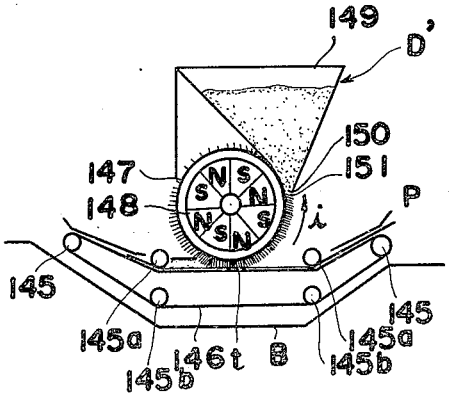
FIG. 15 is a schematic diagram showing a sectional side view of a dry type developing device applicable to the copying apparatus in FIG. 1.

Although, in the above embodiment of the copying apparatus of the invention, the wet type developing device D having the electrode rollers 41 and 42 is employed, it should be noted that a dry type developing device, for example, a device D′ as shown in FIG. 15 can be adopted instead of the wet type developing device D.

Referring to FIG. 15, the dry type developing device D′ comprises a cylinder 147 which is fixedly provided above an endless belt 146 for transporting the copy paper sheet *p* movably supported by two rollers 145 and suitably urged downward by a pair of rollers 145*a* and another pair of rollers 145*b* rotatably mounted on the forward run and the backward run of the endless belt 146 respectively with the two rollers 145*a* and the two rollers 145*b* in each of said pairs disposed at a predetermined interval to form a flat portion of the endless belt 146 therebetween, a plurality of magnets 148 rotatably disposed in said cylinder 147 and a funnel shaped tank 149 for dispensing toner powder fixedly mounted above the drum 147.

The plurality of magnets 148 enclosed in the cylinder 147 are disposed close to the surface of the forward run of the endless belt 146 and are adapted to rotate in the direction of an arrow i, while an opening 150 is formed at the lower portion of the tank 149 for uniformly supplying toner powder onto the surface of the cylinder 147. The toner powder thus supplied is formed into brush bristles 151 on the surface of said cylinder 147 by the action of the magnets 148.

The copy paper sheet fed onto the forward run of the belt 146 at the right of the device D′ in FIG. 15 is further transported to the developing position t immediately below the cylinder 147 as the belt 146 moves, in which position T the copy paper sheet bearing an electrostatic latent image formed thereon is slightly rubbed by the brush bristles 151 with the latent image visualized by the adhesion of the toner powder to the charged portion thereof, and further fed into the subsequent processing station, such as the fixing device F. The toner particles remaining on the cylinder 147 after passing the exposure position t are carried back to a position in the vicinity of the opening 150 of the tank 149 as the magnets 148 rotate and are replenished with fresh toner from the tank 149 so as to again form brush bristles 151 with uniform tone concentration.

As is clear from the above description, in the copying apparatus of the present invention, the photoreceptor drum which has conventionally required a large space is minimized in its diameter to an optically possible extent with one copying cycle adapted to be completed by more than one revolution of said drum.

Similarly, various processing devices such as the corona charger, the exposure means, the transfer device and the charge erasing means etc., arranged sequentially around the photoreceptor drum are not only minimized, but efficiently disposed, so that the copying apparatus can be compact in size and light in weight.

Furthermore, since the housing of the coyping apparatus of the invention is adapted to be divided into two portions, i.e., the upper frame including the latent image forming means such as the platform for the original, the optical system and the photoreceptor drum, and the lower frame including the copy paper feeding device, the transfer device, the developing device and the drying and fixing device etc., which upper frame is pivotally connected to the lower frame so that the former can be raised or lowered about the pivotal connection, exchanging of the photoreceptor drum and other parts which have deteriorated or worn out after predetermined periods of time can be effected very easily, and should jamming of a copy paper sheet occur during operation of the apparatus, the faulty sheet can be readily removed.

Since various parts and devices are easily accessible as described above, the copying apparatus of the invention is very advantageous both to the user and the manufacturer from the view point of maintenance.

It is another important feature of the copying apparatus of the invention that the dry type developing device can be employed in the apparatus by minor alterations of the associated mechanisms.

If the drying and fixing device comprising the cylinder with the heater enclosed therein and a belt or a plurality of rollers having surfaces of air permeable materials is incorporated in the copying apparatus of the invention, very efficient drying and fixing of the copied paper sheets can be achieved.

Moreover, the adoption of the transparent or semi-transparent casing for the roll of copy paper is very advantageous in confirming the presence and the sizes of copy paper sheets for efficient copying operations.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An electrophotographic copying apparatus of the image transfer type, comprising:

a reciprocatable platform on which an original to be copied may be placed;

a rotatable drum disposed below said platform and having a photoreceptor surface onto which an image of the original to be copied is projected, said drum being adapted to rotate synchronously with movement of said platform disposed above said drum;

means disposed around said drum and including a corona charging means for applying uniform charges onto said drum, an exposure slit means through which an image of the original is projected by reflecting the image through a plurality of mirrors and a lens onto said drum, an electrostatic latent image being formed thereon, an image transfer means for transferring the thus formed electrostatic latent image onto a copying paper, a separating means for separating said copying paper from the drum, and an erasing means for erasing residual charges from the drum;

a paper feeding means disposed along a substantially V-shaped path and including a supporting means, a plurality of pairs of rollers arranged between said image transfer means and said supporting means for supporting the copying paper in the form of a roll, said arrangement of rollers forming the feeding path of said copying paper substantially parallel to a finally reflected path of the original image through said slit;

a cutting means disposed along said feeding path for cutting said copying paper;

a developing means including developing solution disposed at about an apex of said V-shaped path;

a feeding path extending upward from said developing means so as to substantially form the V-shaped path and including a squeezing roller for squeezing excess developing solution from a developed copying paper, an absorbing roller for absorbing excess developing solution from the copying paper, and a fixing device for heat fixing said developed image on the copying paper, said drum being positioned along the feeding path between said pairs of rollers and said developing means, having a diameter of 50 to 100 mm and adapted to rotate more than once for forming an electrostatic latent image of the original.

2. An electrophotographic copying apparatus as set forth in claim 1 wherein said image transfer means includes an electrically insulating roller and a conductive roller adapted to be in contact with the surface of said drum for transferring an electrostatic latent image onto the copying paper fed therebetween.

3. An electrophotographic copying apparatus as set forth in claim 1 wherein said image transfer means which includes an electrically insulating roller and a conductive roller is adapted to be in contact with the drum surface synchronously with said separating means.

4. An electrophotographic copying apparatus as set forth in claim 1 wherein said fixing means comprises a rotatable heat conductive cylinder having a heating means therein and forming a feeding path with a rotatable member made of material having fine permeability by feeding the copying paper therebetween.

5. An electrophotographic copying apparatus of the image transfer type, comprising:

a reciprocatable platform on which an original to be copied may be placed;

a rotatable drum disposed below said platform and having a photoreceptor surface onto which an image of the original to be copied is projected, said drum being adapted to rotate synchronously with movement of said platform disposed above said drum;

means disposed around said drum and including a corona charging means for applying uniform charges onto said drum, an exposure slit means through which an image of the original is projected by reflecting the image through a plurality of mirrors and a lens onto said drum, an electrostatic latent image being formed thereon, an image transfer means for transferring the thus formed electrostatic latent image onto a copying paper, a separating means for separating said copying paper from the drum, and an erasing means for erasing residual charges from the drum;

a paper feeding means disposed along a substantially V-shaped path and including a supporting means, a plurality of pairs of rollers arranged between said image transfer means and said supporting means for supporting the copying paper in the form of a roll, said arrangement of rollers forming the feeding path of said copying paper substantially parallel to a finally reflected path of the original image through said slit;

a cutting means disposed along said feeding path for cutting said copying paper;

a developing means disposed at about an apex of said V-shaped path and including a magnetic member enclosed in a cylindrical member with a toner dispensing means disposed adjacent thereto for developing the copying paper; and a feeding path extending upward from said developing means so as to substantially form the V-shaped path and including a fixing device for heat fixing said developed image on the copying paper, said drum being positioned along the feeding path between said pairs of rollers and said developing means, having a diameter of 50 to 100 mm and adapted to rotate more than once for forming an electrostatic latent image of the original.

* * * * *